United States Patent [19]

Bordelon

[11] 4,044,922

[45] Aug. 30, 1977

[54] PROTECTIVE DEVICE

[76] Inventor: Lewis O. Bordelon, 300 Dulles St., Lafayette, La. 70501

[21] Appl. No.: 689,866

[22] Filed: May 25, 1976

[51] Int. Cl.[2] ..... B65D 83/14; B05B 15/06

[52] U.S. Cl. ..... 222/183; 222/402.11; 239/289; 239/579

[58] Field of Search ..... 42/1 G; 222/402.11, 222/402.13, 402.15, 183; 239/582, 579, 577, 373, 283; 273/84 R

[56] References Cited

U.S. PATENT DOCUMENTS

| | | | |
|---|---|---|---|
| 2,001,405 | 5/1935 | Abbott | 42/1 G |
| 2,911,159 | 11/1959 | Doyle | 222/402.15 X |
| 3,143,254 | 8/1964 | Vanderhyde | 222/402.11 |
| 3,235,992 | 2/1966 | Busillo | 42/1 G |
| 3,252,626 | 5/1966 | Belka | 222/402.13 X |
| 3,314,577 | 4/1967 | Doblin | 222/402.15 X |
| 3,648,905 | 3/1972 | Kauder | 222/402.13 X |

*Primary Examiner*—Evon C. Blunk
*Assistant Examiner*—Andres Kashnikow
*Attorney, Agent, or Firm*—Clarence A. O'Brien; Harvey B. Jacobson

[57] ABSTRACT

An anti-personnel device, small enough to be concealed in the hand of the user, the anti-personnel portion being housed in a container having an appearance which belies its use, the container comprising a cap attached by complementary threads to a main body portion, the cap having a central bore in its end portion, and which cap supports the actuating means for a replaceable aerosol cartridge which is housed in the main body portion and which contains anti-personnel spray fluid under pressure. Actuating means which includes a safety latch which in closed position engages the top end of the cap and in deflected and depressed position constitutes a push button for actuating the valve system of the cartridge so that the liquid under pressure will escape through the bore in the cap, and a key ring detachably secured to the container at the end opposite the cap and which is readily disconnected therefrom.

10 Claims, 5 Drawing Figures

PROTECTIVE DEVICE

BACKGROUND OF THE INVENTION

People are accosted on the street, in parking garages, elevators and at the entrance to their apartments. Often a person who is unlocking the car or apartment door is most vulnerable to attack. It is these circumstances which may make anti-personnel sprayers necessary.

Anti-personnel immobilizing sprayers which may be hand-carried are known in the defense art, see Black U.S. Pat. No. 3,385,601 and Osses U.S. Pat. No. 2,432,791. In the former, the sprayer is aerosol. The patent to Commarato U.S. Pat. No. 2,766,072 discloses replaceable cartridges in the aerosol sprayer art.

SUMMARY OF THE INVENTION

The present device is meant to be used by either men or women, is small and compact and can be carried in the hand, in a pocket or in the pocketbook.

It is a defensive weapon which should be kept available when people get into trouble. It is economical to manufacture, employing readily available replacement parts and is simple to use. It is lightweight, small and can be used in one hand, is inconspicuous and, therefore, has the advantage of the element of surprise in an adversary situation. It has a safety mechanism and cannot discharge except by a flick of the thumb in a motion similar to using a lighter, plus an added depressed motion.

The device is a suitable adjunct to a key ring, because keys are kept in available places and can be tactily acknowledged and found without looking down or away. Ofter people are victimized just as they are unlocking the car or apartment door and that is why having a defensive weapon at hand at such a time is most advantageous. The special features inherent in this deterent device include its lightweight and compact design, its inconspicuous and attractive appearance, its ready availability and its ease of use.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
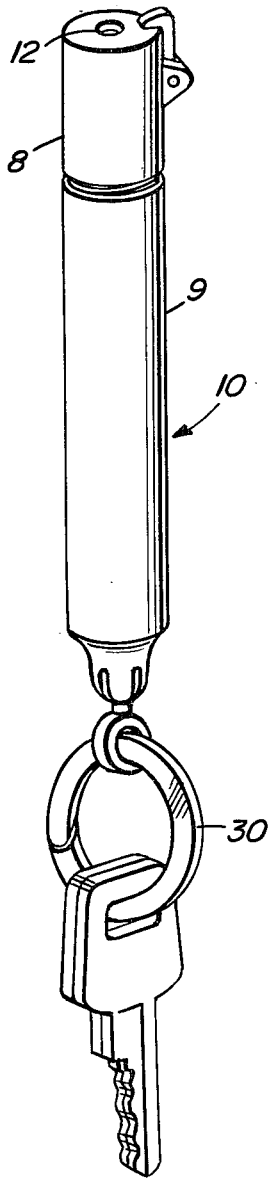
FIG. 1 is a perspective view of the container and its attached key ring.
Figure 2:
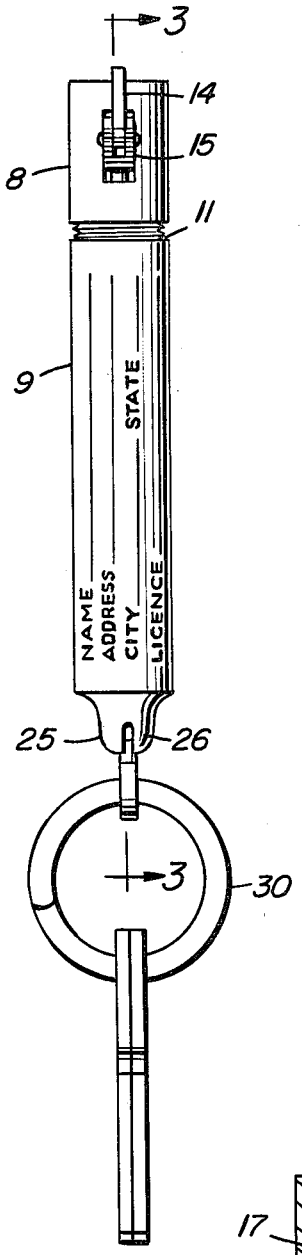
FIG. 2 is a side view of the container and key ring.

Referring now to the drawings in detail wherein like reference characters indicate like parts throughout the several figures, numeral 10 indicates the container in its entirety. The cap portion 8 of the container is secured to the main body of the container 9 by complementary threads 11. The cap has a central bore 12 on its upper surface, and a vertical slot 13 on its outer peripheral surface. A trigger mechanism indicated as A, B in FIG. 5 of the drawings will now be more fully described.

Figure 3:
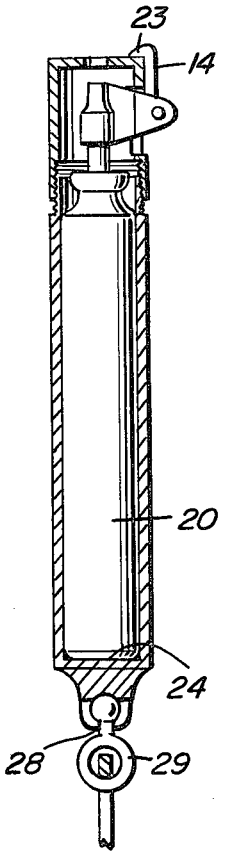
FIG. 3 is a cross-sectional view taken on line 3—3 of FIG. 2 in safety latched position.
Figure 4:
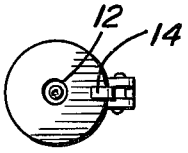
FIG. 4 is a top end view of the container.
Figure 5:
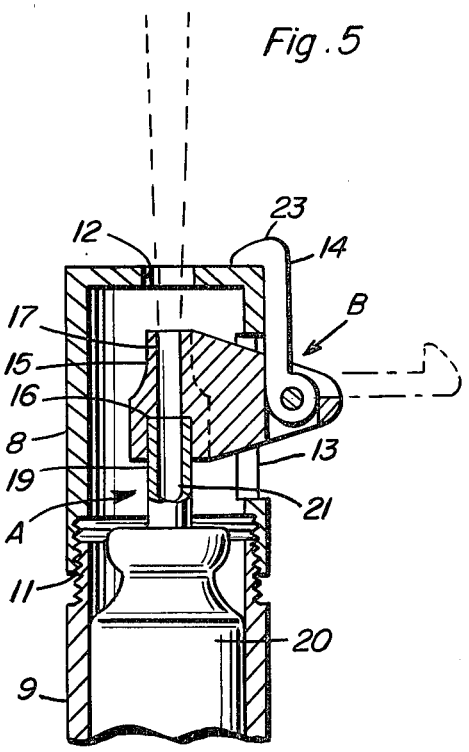
FIG. 5 is an enlarged sectional view of the container indicating in phantom the latch in operating position.

That part indicated as B is associated with the cap and that of A with the cartridge 20. A plunger 15, a portion of which extends through a vertical slot 13 in the cap, and upon which latch 14 is pivotally mounted is housed within the cap. The plunger has a bearing surface 16 which engages the nozzle 19 extending from the cartridge 20, which cartridge has the standard aerosol valve. The plunger has an opening 17 aligned with opening 12 of the cap and 21 of the nozzle, see FIG. 5. Latch 14 has a hooked end 23 which in closed position, see FIG. 3, engages the top surface of the cap, and in open position, as shown in dotted lines in FIG. 5, is pivoted to extend at right angles to its closed position and to provide a push button for depressing the plunger bearing surface 16 against the nozzle, thus actuating the valve in the cartridge. The replaceable cartridge 20 contains an anti-personnel liquid such as "Mace" under pressure, which upon depression of the nozzle 19 will escape through aligned openings 21, 17 and 12, the latter forming a spray cone. The spray is of such a deterrant nature so as to discourage, disable and immobilize aggressors.

At the other end of the case which has a closed bottom 24 is appended a narrowed cone portion having separated spring resilient metal leaves, such as 25 and 26. The constitute a resilient socket means which may engage a ball 28 from which depends a loop 29 for the reception of a key ring holder 30. The ball and socket connection is easily broken as by the sidewise pressure on the loop.

The body of the case may contain a printed message, advertising, or identification in case of loss, or the address where replacement cartridges may be obtained. The case may be made of plastic or metal decorated to give it the appearance of a cosmetic case or lighter.

In operation, the user palms the case or grasps it, flicks back the hook end of the latch downwardly with the thumb or other available digital member, aims the opening of the cap 12 and further depresses the latch to discharge the spray. It is that simple.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. An anti-personnel spray container having article retaining means, said container comprising a case having a cap removably fastened to the body of the case, a replaceable aerosol cartridge containing a fluid immobilizing agent under pressure enclosed in the main body of the case, said cartridge having a nozzle with a central opening therein, said nozzle extending into the cap, the cap having a central opening on the end thereof in alignment with the opening of the nozzle, mechanism within the container to effectuate release of the fluid under pressure, and pivotally mounted hook means associated with said mechanism and extending to the outside of the cap which acts both as a safety latch to prevent release of fluid under pressure and alternately as a push button to trigger the mechanism to release the fluid under pressure.

2. An anti-personnel spray container as in claim 1 in which said mechanism within the container to effectuate release of the fluid under pressure includes a plunger seated over the nozzle and having an opening in alignment with the openings in the nozzle and cap to form a continuous axially aligned passageway for the spray, and a portion associated with the plunger extending through a slot in the cap for supporting said pivotally mounted hook means externally of the cap.

3. An anti-personnel spray container as in claim 2 in which said article retaining means comprises a resilient socket depending from the lower end of the container opposite the capped end and complementary ball means with an attached loop for holding articles.

4. An anti-personnel spray container as in claim 3 in which the ball and socket joint is readily disconnected.

5. An anti-personnel spray container as in claim 3 in which a key ring is attached to the loop.

6. An anti-personnel spray container comprising an elongated case having a cap threaded to the body of the case, a replaceable aerosol cartridge containing an immobilizing fluid under pressure enclosed in the body of the case, said cartridge having a nozzle extending into the cap, a trigger mechanism within the cap comprising a plunger seated over the nozzle and having a portion of the plunger extending laterally through a vertical slot in the periphery of the cap, a latch member hooked at one end and pivotally mounted at the other end upon the plunger portion which extends through the slot, the hooked end being adapted to engage the top of the cap in which position the device is inoperable.

7. An anti-personnel spray container as in claim 6 in which the hooked end of the latch may be deflected and further depressed to actuate the trigger mechanism and release the spray.

8. An anti-personnel spray container as in claim 7 in which the cap has a central bore opening in alignment with the opening of the nozzle and the plunger has an opening aligned with the cap and nozzle openings to form a continuous passageway for the spray.

9. An anti-personnel spray container as in claim 8 in which an article holder is attached to the bottom end of said container for releasably coupling an article to the container.

10. An anti-personnel spray container as in claim 9 in which the release coupling comprises a ball and socket joint.

* * * * *